United States Patent [19]

Mayer

[11] Patent Number: 4,791,252

[45] Date of Patent: Dec. 13, 1988

[54] TOUCH PANEL SWITCH OPERATING ARRANGEMENT

[75] Inventor: Klaus Mayer, Obertshausen, Fed. Rep. of Germany

[73] Assignee: VDO Adolf Schindling AG, Frankfurt am Main, Fed. Rep. of Germany

[21] Appl. No.: 86,182

[22] Filed: Aug. 14, 1987

Related U.S. Application Data

[63] Continuation of Ser. No. 900,218, Aug. 26, 1986, abandoned.

[30] Foreign Application Priority Data

Aug. 30, 1985 [DE] Fed. Rep. of Germany ..... 3530971

[51] Int. Cl.[4] ..... H01H 9/00; H01H 35/00

[52] U.S. Cl. ..... 200/52 R; 200/5 R

[58] Field of Search ..... 200/5 R, 5 A, 5 E, 6 R, 200/6 A, 61.54, 61.55, 52 R, 159 B, 340, 308; 235/145 R

[56] References Cited

U.S. PATENT DOCUMENTS

| | | | |
|---|---|---|---|
| 3,005,055 | 10/1961 | Mattke | 200/6 A X |
| 3,699,294 | 10/1972 | Sudduth | 200/5 A X |
| 4,180,713 | 12/1979 | Gonzales | 200/52 R |
| 4,308,439 | 12/1981 | Itoh | 200/5 E X |
| 4,473,724 | 9/1984 | Suzuki | 200/6 R X |
| 4,517,424 | 5/1985 | Kroczynski | 200/52 R |
| 4,518,836 | 5/1985 | Wooldridge | 200/61.54 |
| 4,584,443 | 4/1986 | Yaeger | 200/6 A |
| 4,638,131 | 1/1987 | Kidd et al. | 200/5 A X |

FOREIGN PATENT DOCUMENTS

| | | | |
|---|---|---|---|
| 1145692 | 3/1963 | Fed. Rep. of Germany | 200/340 |

*Primary Examiner*—J. R. Scott

*Attorney, Agent, or Firm*—Martin A. Farber

[57] ABSTRACT

A plurality of sensor surfaces upon the touching of which an electric pulse is given off are arranged on a surface in an operating arrangement; the surface is surrounded by a frame whose surface is so shaped three-dimensionally as to provide the operator with a feelable indication of the position of the individual sensor surfaces.

4 Claims, 1 Drawing Sheet

FIG. 1
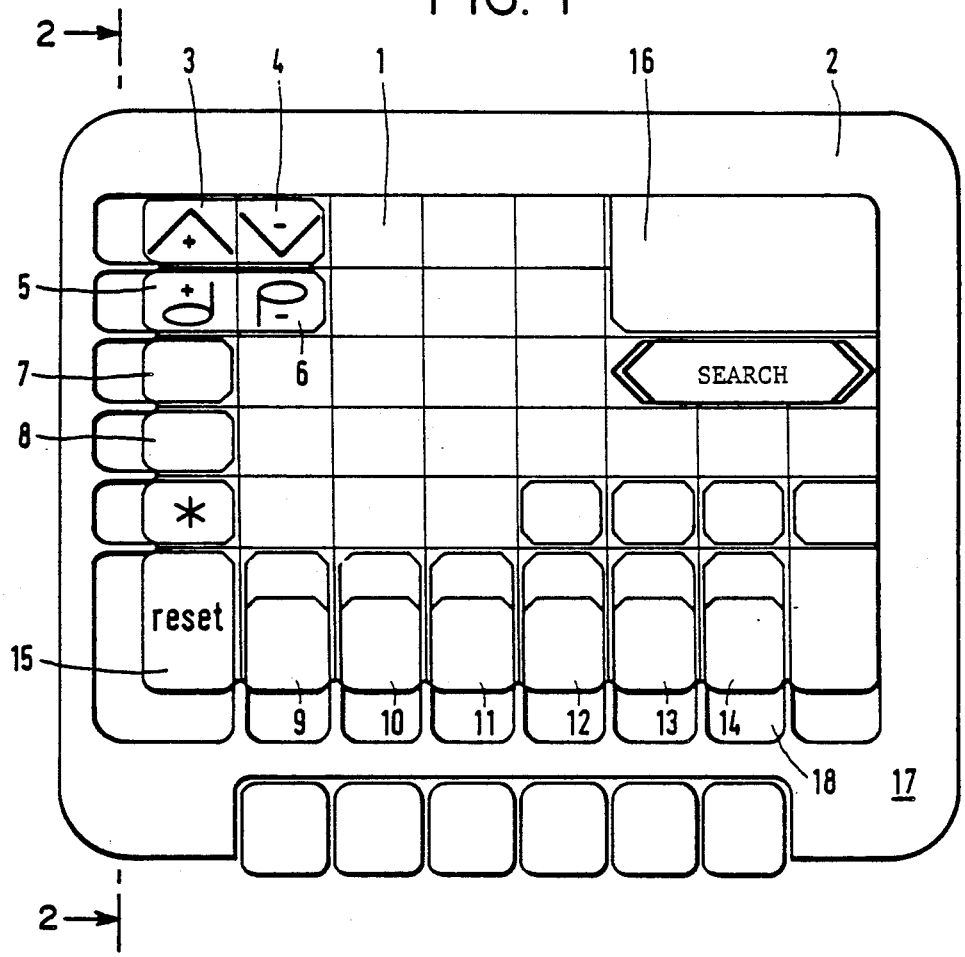
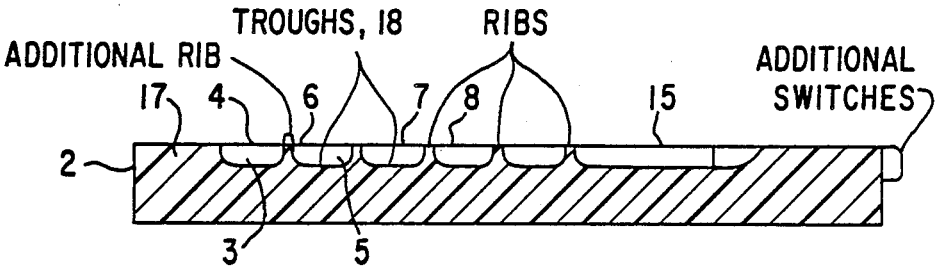
FIG. 2

TOUCH PANEL SWITCH OPERATING ARRANGEMENT

RELATED APPLICATION

This application is a continuation of my co-pending application Ser. No. 900,218 filed Aug. 26, 1986 now abandoned.

FIELD AND BACKGROUND OF THE INVENTION

The present invention relates to an operating arrangement in which a plurality of sensor surfaces upon the contacting of which an electric pulse is produced are arranged on a surface.

For the operating of, in particular, electronic instruments and control devices, there have proven suitable, inter alia, sensor keys which have no mechanically movable parts and therefore also no mechanical contacts. Aside from their great reliability and long life, these sensor keys have the advantage that they form a closed surface with the parts surrounding them, as a result of which dirtying of the inside of the apparatus provided with the sensor keys is avoided and the cleaning of the outside is facilitated. An arrangement of several such sensor keys can be formed, for instance, by a picture screen on which sensor surfaces are projected and which is connected to a control and evaluation circuit. However, sensor keys are also known in which the rear side of a foil is provided with electrodes and the front side bears corresponding legends.

For various uses, particularly in automotive vehicles, it has been found that, as a result of the smooth surface, accurate orientation of the operator is possible only by means of increased attentiveness. Upon casual reaching as is necessary, for instance, for the operating of an automobile radio during travel, erroneous operating maneuvers are not out of the question.

SUMMARY OF THE INVENTION

It is an object of the present invention to provide a form of control panel keys which, while retaining the aforementioned advantages, permits accurate operation even upon casual reaching by an operator.

According to the invention, the surface (1) is surrounded by a frame (17) the surface of which is so three-dimensional as to provide the operator with a feelable indication of the position of the individual sensor surfaces (3 to 15).

The operating arrangement in accordance with the invention has the advantage that, by the elimination of mechanical contacts, long life and high reliability are assured while nevertheless only a slight degree of attentiveness on the part of the operator is needed in order properly to strike the individual sensor surfaces.

In accordance with a further development of the invention, the frame (17) has troughs (18) which are of the same size as the sensor surfaces (3 to 15) which lie alongside of them.

In order to provide an aid in orientation also with respect to sensor surfaces which do not lie at the edge of the surface, one or more ribs provided with troughs are, in accordance with another development of the invention, also provided on the surface (1) in addition to the frame (17).

The operating arrangement of the invention can have as sensor surfaces a picture screen as well as individual electrodes arranged on the back of a foil.

In this respect the surface (1) can be formed of a picture screen onto which the sensor surfaces (3 to 15) are projected and which is connected with a known control and evaluation circuit, or the surface (1) can be formed of a foil on the rear of which electrodes which correspond to the sensor surfaces are arranged, the foil bearing a corresponding printed legend on its front side.

The frame (17) which contains the troughs can be part of a housing (2) which surrounds the operating arrangement.

BRIEF DESCRIPTION OF THE DRAWING

The above and other objects will become more clearly understood in connection with the description of one embodiment of the invention shown in the drawing, wherein FIG. 1 is a plan view of a picture screen; and FIG. 2 is a sectional view taken along the line 2—2 in FIG. 1.

DETAILED DESCRIPTION OF THE PREFERRED EMBODIMENT

Various operating elements (sensor surfaces and indicating devices) which serve for the operating of an automobile radio are projected onto the surface of a picture screen 1. The picture screen in held in a housing 2. The sensor surfaces 3, 4, 5 and 6 are arranged in each case in pairs and serve to increase and reduce the volume as well as adjust the tone. Two other sensors surfaces 7, 8 are intended for radio traffic reports. Furthermore, the sensor surfaces 9, 10, 11, 12, 13, 14 serve a station keys, while a larger sensor surface 15 which serves as reset key returns the radio to a basic operating position. Aside from the sensor surfaces, the operating unit also has display surfaces such as, for instance, the station and frequency display 16. Alongside the sensor surfaces 3 to 15 present at the edge of the surface of the picture screen, troughs 18 are provided on the frame 17 of the housing 2. The operator can now, in order for his finger to land in each case exactly on the corresponding station surface, tough the sensor surface in the manner that he feels the corresponding trough. Or, with a movement of the finger which slides over the trough, he can arrive on those sensor surfaces 4, 6 which do not lie directly at the edge of the picture screen 1.

As shown in FIG. 2, the troughs 18 which are positioned on two sides of the frame 17 of the housing 2 are provided with a shape that easily accepts a probing finger. This allows a driver of a vehicle to find a specific location on a peripheral region of the housing 2 without lifting his eyes from the roadway. This facilitates finding and operation of sensor surfaces such as the sensor surfaces 5, 7 and 8, as well as additional switches located along the bottom edge of the housing, which additional switches may be employed for selecting functions such as a radio, tape deck, etc.

I claim:

1. A control panel configuration consisting of a plurality of sensor keys arranged on a flat surface of the panel, each of said keys being responsive to a touch of a respective sensor key surface to produce an electric pulse, the sensor keys forming a smooth, closed surface with continuous parts of the control panel;

the panel surface being surrounded by a frame with a surface configured in three-dimensions, the configuration of the frame surface including a sequence of undulations aligned with sensor key surfaces in a predetermined peripheral pattern providing an operator with a feelable indication of the position of the individual sensor key surfaces; and wherein the surface undulations of the frame have troughs which are of the same size as corresponding sensor key surfaces, the troughs lying alongside respective ones of the sensor key surfaces, and being positioned on the frame for receiving a human finger, thereby to guide the finger to a selected key surface;

the panel surface being generally flat and being provided also with at least one rib for accessing sensor surfaces which do not lie at the edge of the panel surface.

2. The control panel configuration according to claim 1, wherein a region of the panel surface defines a pictorial layout showing images for operation of the control panel.

3. The control panel configuration according to claim 1, wherein the panel surface provides a legend for a sensor key.

4. The control panel configuration according to claim 1, wherein the panel includes a housing which surrounds the keys, and the frame which contains the troughs is a part of the housing.

* * * * *